US007508402B2

(12) United States Patent
Yin et al.

(10) Patent No.: US 7,508,402 B2
(45) Date of Patent: Mar. 24, 2009

(54) APPARATUS AND METHOD FOR REALIZING GRAY LEVELS OF LCD

(75) Inventors: Xin She Yin, Kyoungki-do (KR); Hyung Dae Kim, Kyoungki-do (KR)

(73) Assignee: Hydis Technologies Co., Ltd, Gyeonggi-Do (KR)

( * ) Notice: Subject to any disclaimer, the term of this patent is extended or adjusted under 35 U.S.C. 154(b) by 789 days.

(21) Appl. No.: 11/207,651

(22) Filed: Aug. 18, 2005

(65) Prior Publication Data

US 2006/0103617 A1 May 18, 2006

(30) Foreign Application Priority Data

Nov. 12, 2004 (KR) ..... 10-2004-0092712

(51) Int. Cl.
*G09G 5/10* (2006.01)

(52) U.S. Cl. ..... 345/691

(58) Field of Classification Search ..... 345/89, 345/690–693

See application file for complete search history.

(56) References Cited

U.S. PATENT DOCUMENTS 6,191,535 B1 * 2/2001 Saitou ..... 315/169.3
6,952,193 B2 * 10/2005 Abe et al. ..... 345/87
7,106,277 B2 * 9/2006 Ando et al. ..... 345/58
7,126,592 B2 * 10/2006 Willis et al. ..... 345/204
7,176,948 B2 * 2/2007 Lewis ..... 345/691
7,180,487 B2 * 2/2007 Kamikawa et al. ..... 345/83
7,277,076 B2 * 10/2007 Shiomi et al. ..... 345/89
2002/0145584 A1 * 10/2002 Waterman ..... 345/98
2003/0011545 A1 * 1/2003 Sagano et al. ..... 345/76
2004/0174388 A1 * 9/2004 Sempel et al. ..... 345/691
2005/0231535 A1 * 10/2005 Akima ..... 345/691
2006/0114271 A1 * 6/2006 Takeda ..... 345/690

* cited by examiner

*Primary Examiner*—Sumati Lefkowitz
*Assistant Examiner*—Rodney Amadiz

(57) ABSTRACT

Disclosed is an apparatus and a method, in which gray levels are realized in such a manner that a pixel is supplied with a constant current instead of a voltage and charging duration (required for inputting data until a gate is turned on/off) is time-divided by the number of gray levels to be realized. The apparatus includes a current supplier for supplying a current filling a pixel, a buffer for latching display data, an adder for adding currently-input display data and display data latched the buffer, a pulse generator for receiving data outputted from the adder and delivering a switch-on pulse having a pulse width corresponding to the outputted data to the current supplier, and a controller for controlling the current supplier, the adder, and the pulse generator.

5 Claims, 4 Drawing Sheets

APPARATUS AND METHOD FOR REALIZING GRAY LEVELS OF LCD

BACKGROUND OF THE INVENTION

1. Field of the Invention

The present invention relates to an apparatus and a method for realizing gray levels, and more particularly to an apparatus and a method, in which gray levels are realized in such a manner that a pixel is supplied with a constant current instead of a voltage and charging duration (required for inputting data until a gate is turned on/off) is time-divided by the number of gray levels to be realized.

2. Description of the Prior Art

As generally known in the art, a liquid crystal display (LCD) device has a plurality of pixels arranged in a matrix structure between a plurality of data lines and a plurality of scan lines, and an anode and a cathode of each pixel are linked with the data line and the scan line, respectively, so that one display panel is formed. Such an LCD emits light to a pixel when a voltage difference between the data line and the scan line exceeds a threshold voltage of the pixel and varies the brightness of the pixel according to time during which a current flows in the pixel, so that a variety of gray levels can be realized.

FIG. 1 is a block diagram illustrating a structure of the conventional apparatus for realizing gray levels.

The conventional apparatus includes a shift register 10, a data register 11, a data latch 12, a level shifter 13, a reference voltage generator 14, a D/A converter 15, and an output butter 16.

The shift register 10 supplies edge sampling clocks to the data register 11, and the data register 11 loads RGB data supplied from a timing controller (not shown) according to the edge sampling clocks provided from the shift register 10. Thereafter, the RGB data are stored as all display data through one horizontal line and then move into the data latch 12.

The reference voltage generator 14 receives a gamma voltage inputted from an external device so as to generate gray levels of 256 (8 bits) or gray levels of 64 (6 bits) through an internal R-string circuit.

The DA converter 15 receives the display data outputted from the data latch and generates an output voltage corresponding to the input display data based on a reference voltage of each gray level provided from the reference voltage generator 14.

The output buffer 16 including an operation amplifier for driving an LCD panel maintains a predetermined voltage for scan duration of one horizontal line through which output signals of the output buffer 16 are input once. Charging time for all input gray levels is equal to the scan duration of one horizontal line, and each different voltage is required in order to output each different gray level. However, the conventional apparatus for realizing gray levels has a limitation in the realization of various gray levels because the range of input gamma voltages is small. In other words, a gamma voltage inputted to the conventional apparatus for realizing gray levels has a voltage level of 5 mV. Therefore, the conventional apparatus for realizing gray levels cannot realize a variety of gray levels due to a small level of a gamma voltage when the apparatus realizes gray levels of 1024 (10 bits) or more.

SUMMARY OF THE INVENTION

Accordingly, the present invention has been made to solve the above-mentioned problems occurring in the prior art, and an object of the present invention is to provide an apparatus and a method for realizing gray levels, which can stably realize relatively-many gray levels by using a constant current in the realization of the gray levels.

To accomplish the above object, there is provided an apparatus for realizing gray levels of a liquid crystal display device, the apparatus including a current supplier for supplying a current filling a pixel, a buffer for latching display data, an adder for adding currently-input display data and display data latched the buffer, a pulse generator for receiving data outputted from the adder and delivering a switch-on pulse having a pulse width corresponding to the outputted data to the current supplier, and a controller 25 for controlling the current supplier, the adder, and the pulse generator.

In the structure, the current supplier includes a positive constant current source, a negative constant current source, and a switch, The positive constant current source and the negative constant current source receiving the switch-on pulse in common and outputting currents to the switch, the switch allowing the pixel to selectively receive currents at a predetermined frame, the currents being outputted from the positive constant current source and the negative constant current source.

In the structure, the positive constant current source and the negative constant current source are alternatively selected by the switch.

According to another aspect of the present invention, there is provided a method for realizing gray levels of a liquid crystal display device, the method including the steps of, (a) receiving and latching first display data, (b) generating a first switch-on pulse having a pulse width corresponding to a value of the first display data, (c) charging a pixel with a first current corresponding to the pulse width of the switch-on pulse, (d) receiving and latching second display data inputted after the first display data, (e) generating third display data by adding the second display data to the latched first display data, (f) generating a second switch-on pulse having a pulse width corresponding to a value of the third display data, and (g) charging the pixel with a second current having a polar opposite to the first current by the second switch-on pulse, wherein fourth display data received after the second display data are processed through steps (d) to (g).

According to another aspect of the present invention, the second current has a data value including the value of the first display data used for discharging the pixel charged by the first current and a value of the second display data used for charging the pixel.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
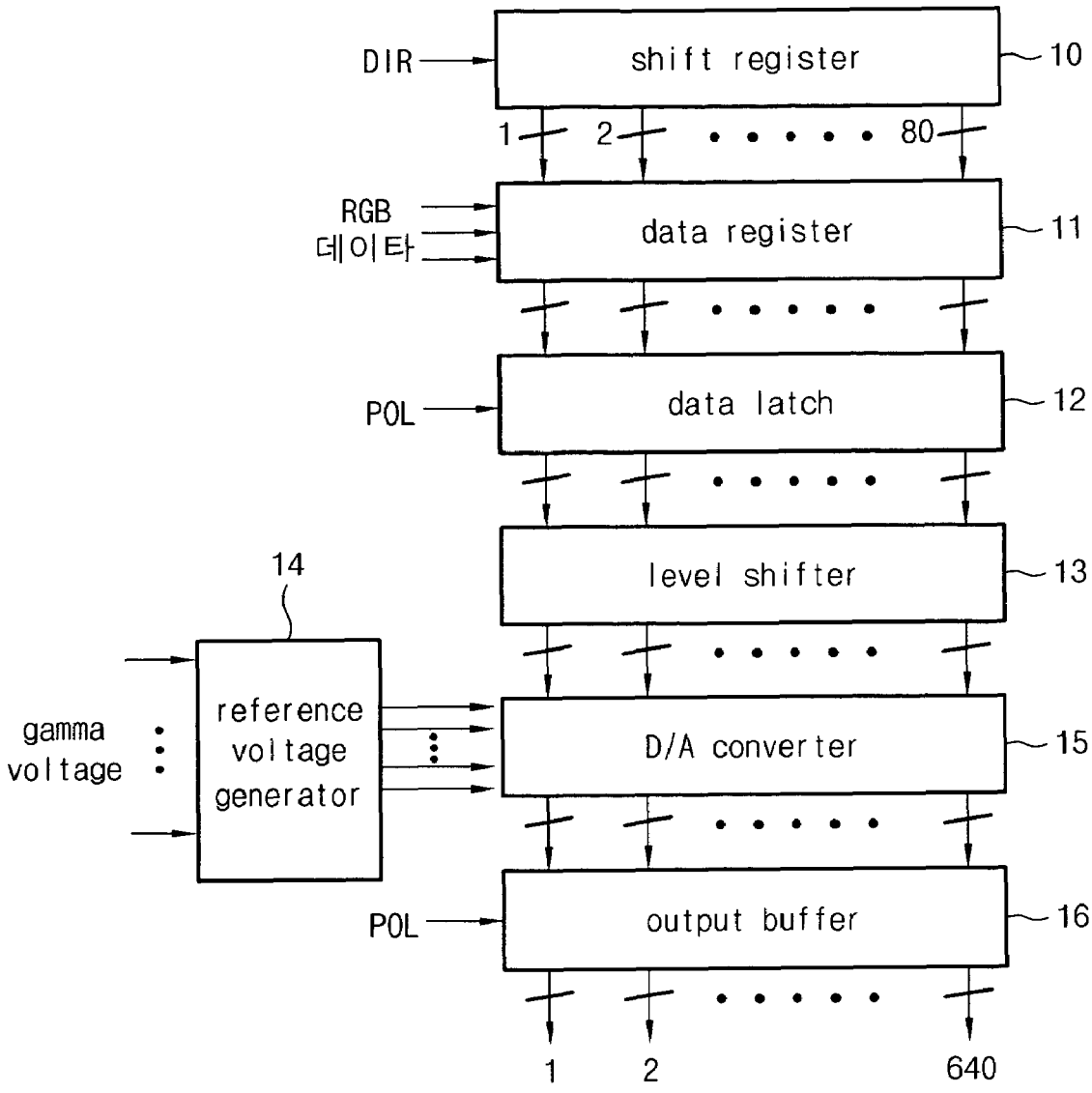
FIG.1 (PRIOR ART)
FIG. 1 is a block diagram illustrating a structure of the conventional apparatus for realizing gray levels.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
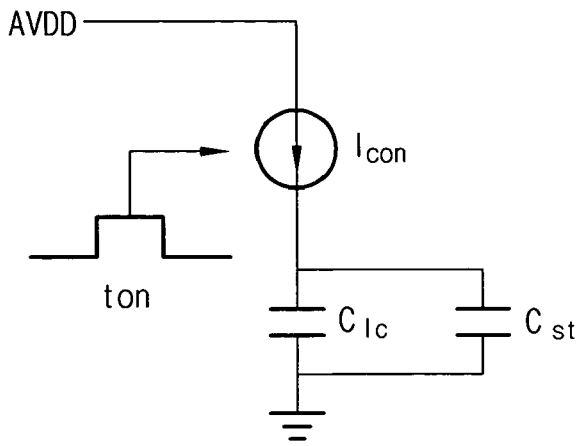
FIG. 2 is a circuit diagram for explaining an operation principle according to the present invention.

FIG. 2 is a circuit diagram for explaining an operation principle according to the present invention.

Both a storage capacitor (Cst) and a liquid crystal capacitor (Clc) included in a liquid cell including an LCD pixel are linked with a current source (Icon) so as to receive charges (Q). Herein, when a driving current of the pixel and the charging duration are indicated as "Icon" and "ton", a total amount of charges loaded into the pixel is defined as following formula (1).

$$Q_{(Clc-Cst)}=\text{Icon}*\text{ton} \quad (1)$$

A pixel voltage is obtained through following formulas (2) and (3).

$$Vlc=Q_{(Clc-Cst)}/(Clc+Cst) \quad (2)$$

$$Vlc=[Icon/(Clc+Cst)]*\text{ton} \quad (3)$$

If values of the current source (Icon), the liquid crystal capacitor (Clc), and the storage capacitor (Cst) are given, it can be understood from formula (3) that the voltage of the liquid cell may be linearly controlled by the charging duration (ton). This refers to that different voltages may be generated with respect to the pixel if different values of the charging duration (ton) are given. In other words, mutually different values of the charging duration are given, so that mutually different gray levels can be obtained.

Figure 3:
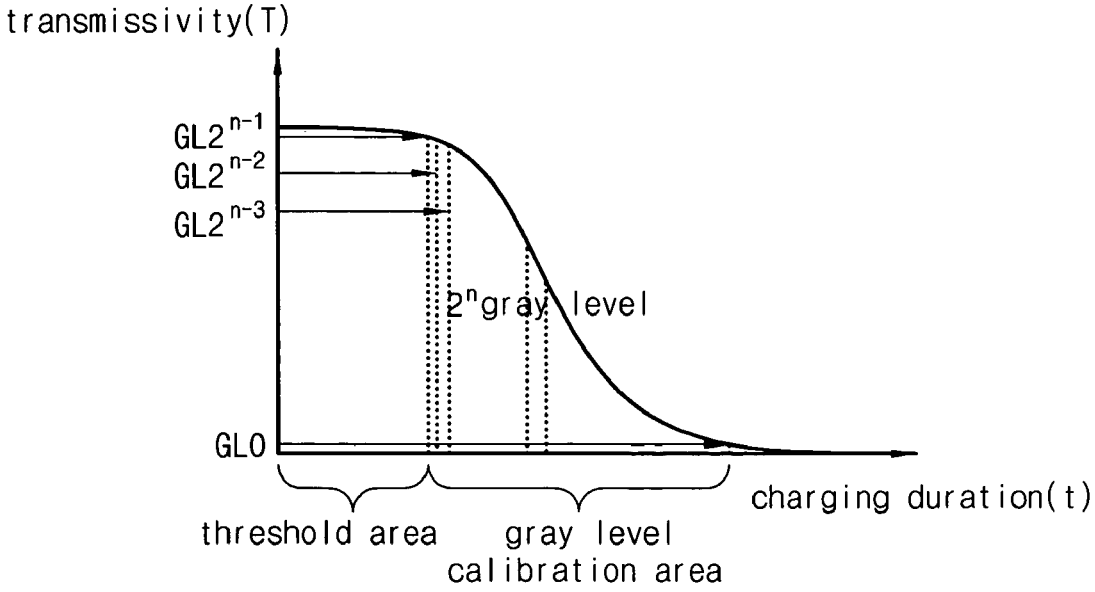
FIG. 3 is a graph illustrating a transmissivity-time curve representing relationship between gray levels and switch-on pulses.

FIG. 3 is a graph illustrating a transmissivity-time curve representing relationship between a gray level and a switch-on pulse.

A threshold area shown in FIG. 3 implies that the minimum charging duration is required for entrance into a gray level calibration area and the transmissivity of liquid crystal rarely changes therein. For example, if n bits are used for realizing $2^n$ gray levels (GLs), the gray level calibration area may be divided into $2^n$ parts. At this time, the gray levels are divided with different charging duration (t).

Figure 4:
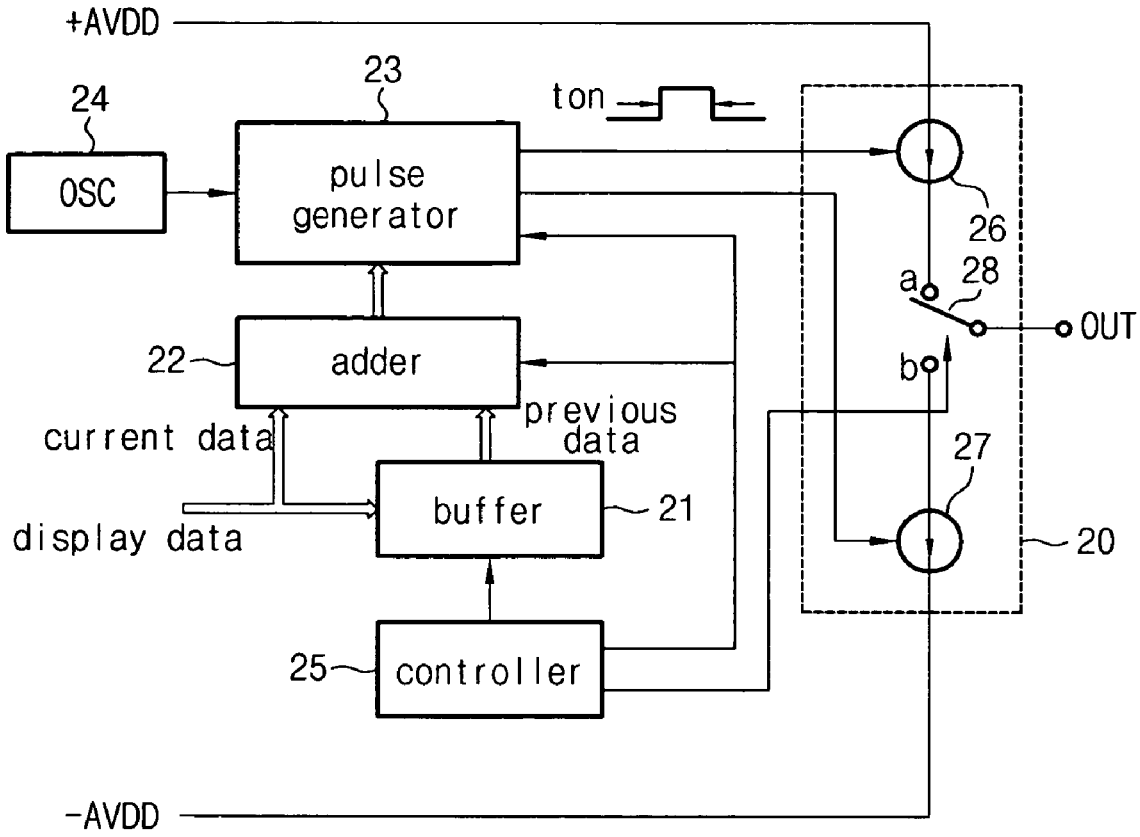
FIG. 4 is a block diagram illustrating an apparatus for realizing gray levels according to the present invention.

FIG. 4 is a block diagram showing an apparatus for realizing gray levels according to the present invention.

A source driver according to the present invention includes a current supplier 20 for supplying a current to a pixel (not shown), a buffer 21 for latching display data, an adder 22 for adding currently-input display data to previous data latched the buffer 21, a pulse generator 23 for receiving data outputted from the adder 22 and delivering a switch-on pulse (ton) having a pulse width corresponding to the outputted data to the current supplier 20, an oscillator 24 for providing a reference clock to the pulse generator 23, and a controller 25 for controlling the current supplier 20, the adder 22, and the pulse generator 23.

The current supplier 20 includes a positive constant current source 26, a negative constant current source 27, and a switch 28. The positive constant current source 26 and the negative constant current source 27 receive the switch-on pulse delivered from the pulse generator 23 in common and supply currents to pixels through the switch 28. At this time, the switch 28 allows currents from the positive constant current source 26 and the negative constant current source 27 to be selectively supplied to the pixels by the controller 25.

Hereinafter, the operation of the apparatus for realizing gray levels will be described.

In the apparatus for realizing the gray levels, initially-input display data are latched by the buffer 21 and inputted to the pulse generator 23 through the adder 22. The pulse generator 23 including an internal counter generates a switch-on pulse (ton) having a pulse width corresponding to the value of the received display data.

Figure 5:
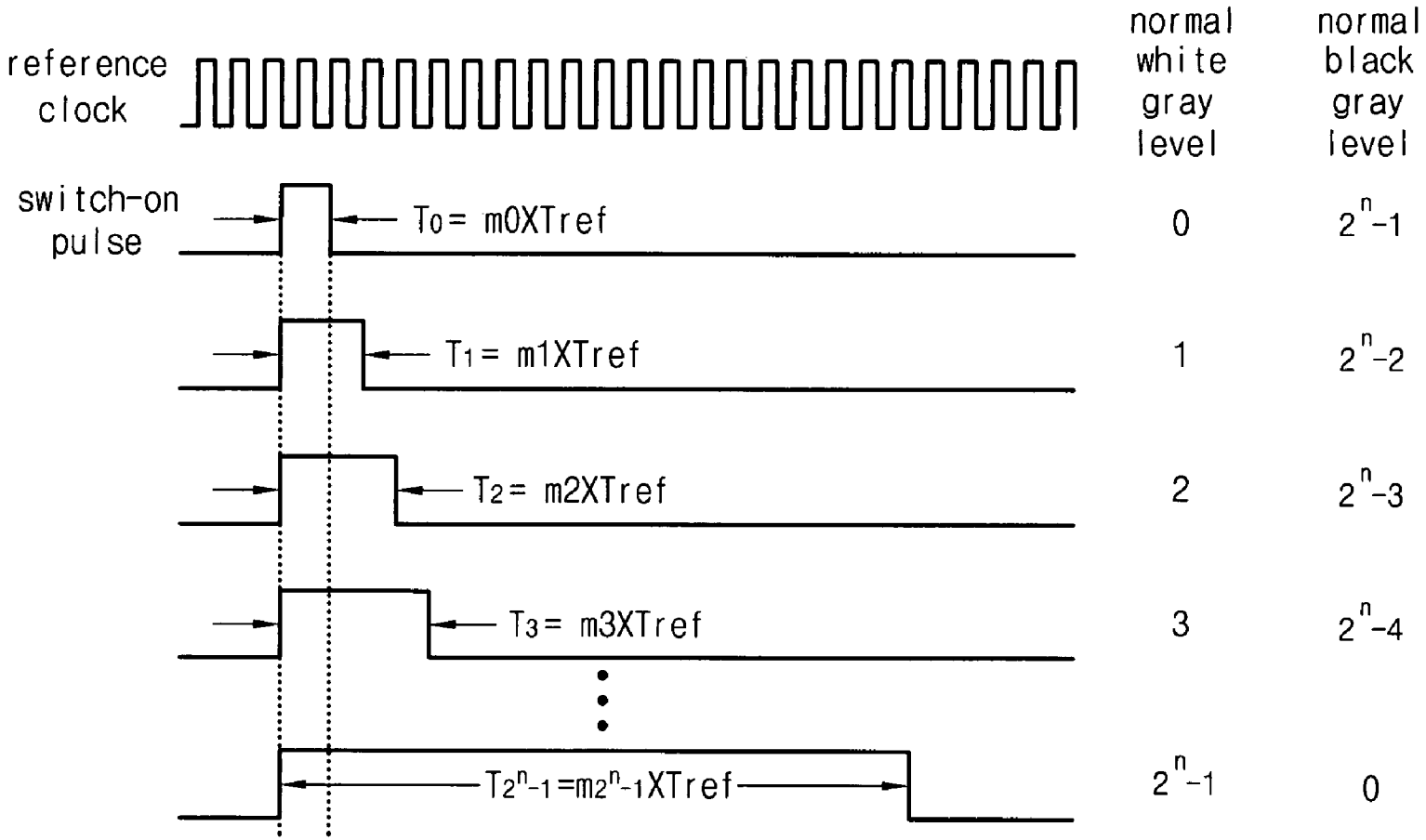
FIG. 5 is a time chart illustrating a detailed internal operation of a pulse generator.

Hereinafter, a detailed internal operation of the pulse generator will be described with reference to FIG. 5. The pulse generator 23 counts the number of reference clock pulses by the value of received display data so as to generate a switch-on pulse having a pulse width corresponding to the counted value. Herein, Tref denotes the duration or the period of the reference clock used as a basic clock in the pulse generator 23, and T0, T1, and T2 denote switch-on pulses (tons) for gray levels GL0, GL1, and GL2, respectively. In addition, m0, m1, and m2 indicate integer values obtained by counting reference clock pulses according to received display data. Each of the pulse widths of the switch-on pulses (tons) determines charging duration required for filling electric charges supplied to each of pixels. The time interval may be divided into several small time units according to types of gray levels. In other words, in the present invention, it is easy to divide the charging duration by raising the frequency of the reference clock supplied to the pulse generator.

The switch-on pulses (tons) generated through the operation are delivered to the current supplier 20. The positive current source 26 and the negative current source 27 receiving the switch-on pulses generate currents for pulse duration. At this time, the controller 25 operates the switch 28 so as to supply currents outputted from a predetermined current source (e.g., the positive current source) to the pixels, and the pixels receiving the currents are filled with positive charges.

After that, if next display data are inputted to the buffer 21 and the adder 22, the buffer 21 outputs previously-latched display data to the adder 22, and the adder 22 adds currently-input display data to the previous display data input from the buffer 21 so as to deliver the added data to the pulse generator 23.

The pulse generator 23 generates a switch-on pulse (ton) having a pulse width corresponding to a value obtained by adding of the current display data to the previous display data. The current supplier 20 having received the switch-on pulse supplies an output current of the negative current source for the duration of the switch-on pulse (ton) to a pixel and fills negative charges in the pixel. Herein, a value of previous display data is eliminated from a data value corresponding to the negative charges, so that the charges corresponding to the previous data filled in the pixel are discharged. Then, the pixel is newly charged based on the value of the current display data. Hereinafter, the comparison of the conventional technique and the present invention will be discussed.

The conventional circuit shown in FIG. 1 realizes gray levels by dividing an input gamma voltage. In contrast, the apparatus for realizing gray levels according to the present invention realizes the gray levels by using a reference clock and current sources. In other words, pixel charging duration is determined by counting reference clock pulses according to display data. Accordingly, as the frequency of the reference clock becomes higher, it is possible to realize more precise and various gray levels.

As described above, according to the present invention, it is easy to realize high gray levels by using a reference clock and current sources. In addition, it is possible to improve the quality of an LCD device by realizing continuous gray levels.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for realizing gray levels of a liquid crystal display device, the apparatus comprising: a current supplier for supplying a current filling a pixel; a buffer for latching display data; an adder for adding currently-input display data and display data latched from the buffer; a pulse generator for receiving data outputted from the adder and delivering a switch-on pulse having a pulse width corresponding to the outputted data to the current supplier; and a controller for controlling the current supplier, the adder, and the pulse generator.

2. The apparatus as claimed in claim 1, wherein the current supplier comprises a positive constant current source, a negative constant current source, and a switch, the positive constant current source and the negative constant current source receiving the switch-on pulse in common and outputting currents to the switch, the switch allowing the pixel to selectively receive currents at a predetermined frame, the currents being outputted from the positive constant current source and the negative constant current source.

3. The apparatus as claimed in claim 2, wherein the positive constant current source and the negative constant current source are alternatively selected by the switch.

4. A method for realizing gray levels of a liquid crystal display device, the method comprising the steps of: (a) receiving and latching first display data; (b) generating a first switch-on pulse having a pulse width corresponding to a value of the first display data; (c) charging a pixel with a first current corresponding to the pulse width of the switch-on pulse; (d) receiving and latching second display data inputted after the first display data; (e) generating third display data by adding the second display data to the latched first display data; (f) generating a second switch-on pulse having a pulse width corresponding to a value of the third display data; and (g) charging the pixel with a second current having a polar opposite to the first current based on the second switch-on pulse.

5. The method as claimed in claim 3, wherein the second current has a data value including both the value of the first display data used for discharging the pixel charged by the first current and a value of the second display data used for charging the pixel.

* * * * *